US006685579B2

(12) United States Patent
Sullivan

(10) Patent No.: US 6,685,579 B2
(45) Date of Patent: Feb. 3, 2004

(54) MULTI-LAYER COVER POLYURETHANE GOLF BALL

(75) Inventor: Michael J. Sullivan, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/853,252

(22) Filed: Apr. 10, 2001

(65) Prior Publication Data

US 2002/0151380 A1 Oct. 17, 2002

(51) Int. Cl.[7] ..... A63B 37/06; A63B 37/04; A63B 37/00

(52) U.S. Cl. ..... 473/357; 473/361; 473/371; 473/351

(58) Field of Search ..... 473/351–377

(56) References Cited

U.S. PATENT DOCUMENTS

| | | | | | |
|---|---|---|---|---|---|
| 5,688,191 | A | | 11/1997 | Cavallaro et al. | 473/373 |
| 5,759,676 | A | | 6/1998 | Cavallaro et al. | 428/215 |
| 5,810,678 | A | | 9/1998 | Cavallaro et al. | 473/373 |
| 5,813,923 | A | | 9/1998 | Cavallaro et al. | 473/373 |
| 5,816,937 | A | * | 10/1998 | Shimosaka et al. | 473/354 |
| 5,830,086 | A | * | 11/1998 | Hayashi et al. | 473/376 |
| 5,873,796 | A | | 2/1999 | Cavallaro et al. | 473/365 |
| 5,885,172 | A | * | 3/1999 | Hebert et al. | 473/354 |
| 5,947,842 | A | | 9/1999 | Cavallaro et al. | 473/373 |
| 5,965,669 | A | | 10/1999 | Cavallaro et al. | 525/221 |
| 5,967,908 | A | | 10/1999 | Yamagishi et al. | 473/373 |
| 5,980,396 | A | * | 11/1999 | Moriyama et al. | 473/376 |
| 6,056,650 | A | * | 5/2000 | Yamagishi et al. | 473/377 |
| 6,095,932 | A | | 8/2000 | Umezawa et al. | 473/356 |
| 6,117,025 | A | * | 9/2000 | Sullivan | 473/373 |
| 6,117,026 | A | * | 9/2000 | Hayashi et al. | 473/371 |
| 6,120,392 | A | | 9/2000 | Kashiwagi et al. | 473/374 |
| 6,124,389 | A | | 9/2000 | Cavallaro et al. | 524/432 |
| 6,126,558 | A | | 10/2000 | Higuchi et al. | 473/374 |
| 6,129,640 | A | | 10/2000 | Higuchi et al. | 473/374 |
| 6,132,324 | A | * | 10/2000 | Hebert et al. | 264/134 |
| 6,152,834 | A | * | 11/2000 | Sullivan | 473/365 |
| 6,206,791 | B1 | * | 3/2001 | Moriyama et al. | 473/374 |
| 6,220,972 | B1 | * | 4/2001 | Sullivan et al. | 473/373 |
| 6,231,461 | B1 | * | 5/2001 | Moriyama et al. | 473/376 |
| 6,251,031 | B1 | * | 6/2001 | Hayashi et al. | 473/376 |
| 6,277,034 | B1 | * | 8/2001 | Nesbitt et al. | 473/359 |
| 6,277,036 | B1 | * | 8/2001 | Hayashi et al. | 473/376 |
| 6,299,550 | B1 | * | 10/2001 | Molitor et al. | 473/354 |
| 6,361,454 | B1 | * | 3/2002 | Yoshida et al. | 473/374 |
| 6,379,266 | B1 | * | 4/2002 | Ogg et al. | 473/357 |
| 6,394,914 | B1 | * | 5/2002 | Sullivan | 473/376 |
| 6,406,383 | B2 | * | 6/2002 | Moriyama et al. | 473/371 |

* cited by examiner

*Primary Examiner*—Paul T. Sewell
*Assistant Examiner*—Alvin A. Hunter, Jr.

(57) ABSTRACT

A golf ball comprising a core and a cover disposed adjacent the core, wherein the cover comprises: an inner cover layer having a first thickness and being disposed directly about the core; an outer cover layer having a second thickness no greater than about 0.050 inches; and an intermediate cover layer having a third thickness and being disposed between the inner and outer cover layers; and wherein the outer cover layer comprises a composition formed of a reactive liquid material; and the combination of the first, second, and third thickness is no greater than about 0.125 inches.

32 Claims, 1 Drawing Sheet

MULTI-LAYER COVER POLYURETHANE GOLF BALL

FIELD OF THE INVENTION

This invention relates generally to golf balls, and more specifically, to a golf ball having a cover comprising three or more layers.

BACKGROUND OF THE INVENTION

The majority of golf balls commercially available today can be grouped into two general classes: solid and wound. Solid golf balls include one-piece, two-piece, and multi-layer golf balls. One-piece golf balls are inexpensive and easy to construct, but have limited playing characteristics and their use is usually confined to the driving range. Two-piece balls are generally constructed with a polybutadiene solid core and a cover and are typically the most popular with recreational golfers because they are very durable and provide good distance. These balls are also relatively inexpensive and easy to manufacture, but are regarded by top players as having limited playing characteristics. Multi-layer golf balls are comprised of a solid core and a cover, either of which may be formed of one or more layers. These balls are regarded as having an extended range of playing characteristics, but are more expensive and difficult to manufacture than are one- and two-piece golf balls.

Wound golf balls, which typically include a fluid-filled center surrounded by tensioned elastomeric material and a cover, are preferred by many players due to their spin and "feel" characteristics but are more difficult and expensive to manufacture than are most solid golf balls. Manufacturers are constantly striving, therefore, to produce a solid ball that retains the beneficial characteristics of a solid ball while concurrently exhibiting the beneficial characteristics of a wound ball.

Golf ball playing characteristics, such as compression, velocity, "feel," and, therefore, spin, can be adjusted and optimized by manufacturers to suit players having a wide variety of playing abilities. For example, manufacturers can alter any or all of these properties by changing the materials (i.e., polymer compositions) and/or the physical construction of each or all of the various golf ball components (i.e., centers, cores, intermediate layers, and covers). Finding the right combination of core and layer materials and the ideal ball construction to produce a golf ball suited for a predetermined set of performance criteria is a challenging task.

Efforts to construct a multi-layer golf ball that has the benefits of both solid and wound balls have been numerous but manufacturers have generally focused on the use of cover layers formed of ionomeric compositions. It has been determined, however, that it is difficult to provide good "feel" characteristics in a golf ball with the use of non-polyurethane materials, such as ionomers, which tend to provide a "plastic feel."

It is desirable, therefore, to construct a golf ball formed of a thin urethane outer cover layer, at least two inner cover layers, and at least one core layer, according to the present invention. In particular, it is desired that this construction produce a multi-layer golf ball having variable spin rates, based on predetermined ball construction, while providing the golfer with good "feel" characteristics generally associated with other conventional ball constructions.

SUMMARY OF THE INVENTION

A golf ball comprising a core and a cover disposed adjacent the core, wherein the cover comprises an inner cover layer having a first thickness and being disposed directly about the core; an outer cover layer having a second thickness no greater than about 0.050 inches; and an intermediate cover layer having a third thickness and being disposed between and adjacent to the inner and outer cover layers; and wherein the outer cover layer comprises a composition formed from a reactive liquid material; and the combination of the first, second, and third thickness is no greater than about 0.125 inches. Preferably, the outer cover layer has a thickness no greater than about 0.035 inches and, more preferably, no greater than about 0.025 inches.

The combination of the inner, intermediate, and outer cover layers should have a thickness of no greater than about 0.105 inches and, more preferably, no greater than about 0.090 inches. The outer cover layer, when formed, can be a castable liquid reactive thermoset material or a reaction injection molding material. If the outer cover layer is formed with a castable liquid reactive thermoset material, it preferably comprises polyurethane, polyurea, polyurethane ionomer, epoxy, or a mixture thereof. In another alternative construction, the intermediate or inner cover layers includes a reaction injection molded material.

The golf ball of the present invention can have a dual core comprising a center and at least one outer core layer or it can be a single solid center. The outer core layer, if present, may include a tensioned elastomeric material or preferably, is solid. In another embodiment, the center is liquid-filled, hollow, foam, gel-filled, or gas-filled.

The outer cover layer should have a hardness of no less than about 55 Shore D or, in an alternative construction, the outer cover layer has a hardness of no greater than about 55 Shore D. The outer cover layer may also include a thermoplastic polyurethane and the inner cover layer and intermediate cover layer may both include a thermoplastic material. If the inner or intermediate layers include a thermoplastic material, it preferably includes ionomers, polyolefins, metallocenes, polyesters, polyamides, thermoplastic elastomers, copolyether-amides, copolyether-esters, and mixtures thereof. The outer cover layer is preferably formed with a specific gravity of between about 0.8 g/cc to about 1.4 g/cc.

The golf ball of the present invention ideally has an inner cover layer having a first hardness of at least about 60 Shore D. Further, the intermediate cover layer has a second hardness and the outer cover layer has a third hardness softer than the hardness of the inner cover layer.

The inner cover layer has a first hardness, the intermediate cover layer has a second hardness, and the outer cover layer has a third hardness. In a first embodiment, the second hardness is less than about 55 Shore D and the third hardness is greater than about 55 Shore D; in a second embodiment, the second hardness is less than about 55 Shore D and the third hardness is less than about 55 Shore D; in a third embodiment, the intermediate layer has a hardness of greater than 55 Shore D and the outer cover layer has a hardness of greater than 55 Shore D; in a fourth embodiment, the intermediate layer has a hardness of greater than 55 Shore D and the outer cover layer has a hardness of less than 55 Shore D; in a fifth embodiment, the intermediate cover layer has a hardness less about 55 Shore D and the inner or outer cover layers; in a sixth embodiment, the first hardness is less than the second or third hardness; in a seventh embodiment, first hardness is less than about 60 Shore D and less than the second hardness; in an eighth embodiment, the second hardness is less than the third hardness; in a ninth embodiment, the second hardness is greater than the third hardness; in a tenth embodiment, the first hardness is less than about 45 Shore D; in an eleventh embodiment, the first hardness is greater than about 70 Shore D; and in a twelfth embodiment, the third hardness is less than about 45 Shore D, the second hardness is less than the first hardness and greater than the third hardness.

The core of the present ball has an outer diameter of about 1.40 inches to about 1.60 inches. Preferably, the core comprises an inner core layer and an outer core layer, wherein the inner core layer has a specific gravity lower than the specific gravity of the outer core layer. Alternatively, the inner core layer has a specific gravity higher than the specific gravity of the outer core layer. The core can include polybutadiene rubber, high-Mooney viscosity polybutadiene rubber, polybutadiene rubber having a trans-isomer content of greater than about 30%, and mixtures thereof.

DETAILED DESCRIPTION OF THE INVENTION

Figure 1:
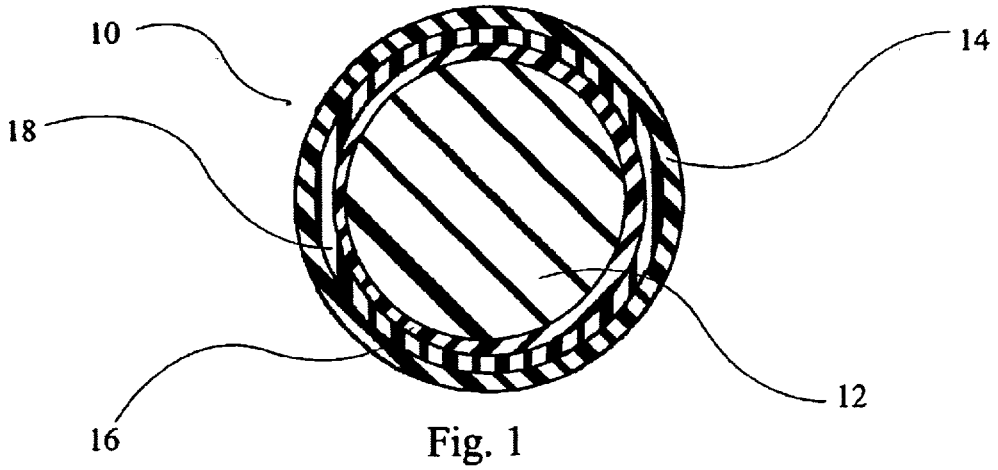
FIG. 1 is one embodiment of the golf ball of the present invention having a solid core and an inner, intermediate, and outer cover layer.
Figure 2:
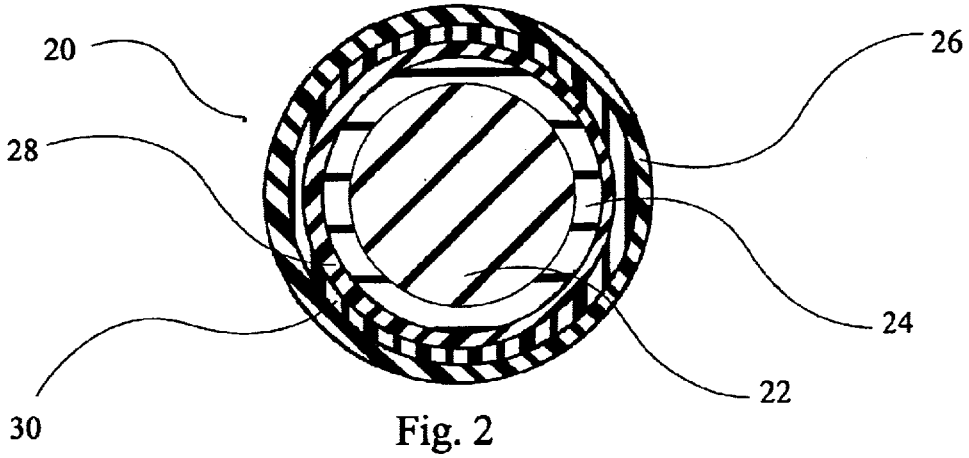
FIG. 2 is a second embodiment of the golf ball of the present invention having a core formed of a solid center and an outer core layer; and an inner, intermediate, and outer cover layer.
Figure 3:
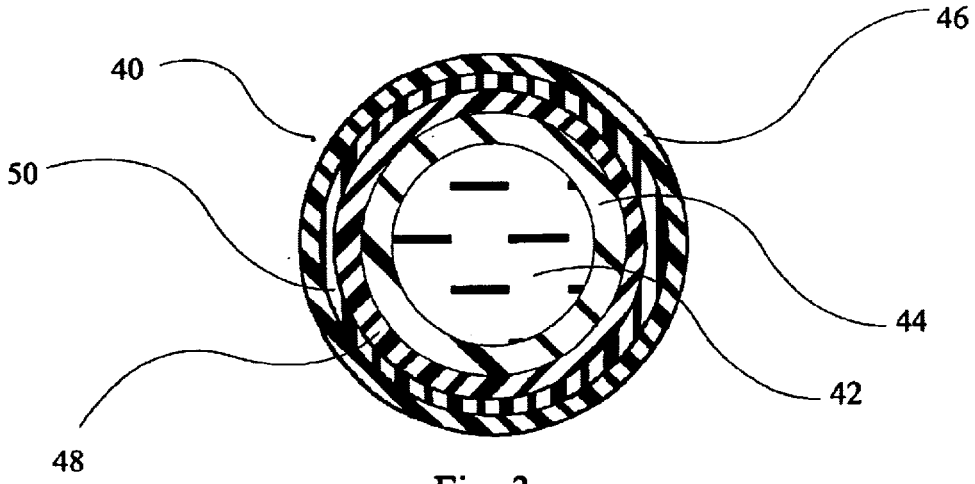
FIG. 3 is a third embodiment of the present invention having a liquid core formed of a liquid center and an outer core layer; and a cover formed of an inner, intermediate, and outer cover layer.

Referring to FIG. 1, a golf ball 10 of the present invention includes a core 12 and a cover comprising an outer cover 14 and at least two inner cover layers, such as inner cover layer 16 and intermediate cover layer 18. The golf ball cores of the present invention may be formed with a variety of constructions. For example, a golf ball 20 may also comprise a core comprising a plurality of layers, such as a center 22 and an outer core layer 24, and a cover comprising an outer cover layer 26, an inner cover layer 28, and an intermediate cover layer 30, as seen in FIG. 2. Referring to FIG. 3, the golf ball 40 may also comprise a core 44 comprising a solid, liquid, foam, gel, or hollow center 42, and a cover comprising an outer cover layer 46, an inner cover layer 48, and an intermediate cover layer 50. Any one of the inner cover layer 48 or the intermediate cover layer 50 may also comprise a tensioned elastomeric material. In a preferred embodiment, the core is a solid core.

Materials for solid cores include compositions having a base rubber, a filler, an initiator agent, and a crosslinking agent. The base rubber typically includes natural or synthetic rubber, such as polybutadiene rubber. A preferred base rubber is 1,4-polybutadiene having a cis-structure of at least 40%. Most preferably, however, the solid core is formed of a resilient rubber-based component comprising a high-Mooney-viscosity rubber and a crosslinking agent.

Another suitable rubber from which to form cores of the present invention is trans-polybutadiene. This polybutadiene isomer is formed by converting the cis-isomer of the polybutadiene to the trans-isomer during a molding cycle. Various combinations of polymers, cis-to-trans catalysts, fillers, crosslinkers, and a source of free radicals, may be used. A variety of methods and materials for performing the cis-to-trans conversion have been disclosed in U.S. Pat. No. 6,162,135 and U.S. application Ser. No. 09/461,736, filed Dec. 16, 1999; Ser. No. 09/458,676, filed Dec. 10, 1999; and Ser. No. 09/461,421, filed Dec. 16, 1999, each of which are incorporated herein, in their entirety, by reference.

Additionally, without wishing to be bound by any particular theory, it is believed that a low amount of 1,2-polybutadiene isomer ("vinyl-polybutadiene") is preferable in the initial polybutadiene to be converted to the trans-isomer. Typically, the vinyl polybutadiene isomer content is less than about 7 percent, more preferably less than about 4 percent, and most is preferably, less than about 2 percent.

Fillers added to one or more portions of the golf ball typically include processing aids or compounds to affect rheological and mixing properties, the specific gravity (i.e., density-modifying fillers), the modulus, the tear strength, reinforcement, and the like. The fillers are generally inorganic, and suitable fillers include numerous metals or metal oxides, such as zinc oxide and tin oxide, as well as barium sulfate, zinc sulfate, calcium carbonate, barium carbonate, clay, tungsten, tungsten carbide, an array of silicas, and mixtures thereof. Fillers may also include various foaming agents or blowing agents, zinc carbonate, regrind (recycled core material typically ground to about 30 mesh or less particle size), high-Mooney-viscosity rubber regrind, and the like. Polymeric, ceramic, metal, and glass microspheres may be solid or hollow, and filled or unfilled. Fillers are typically also added to one or more portions of the golf ball to modify the density thereof to conform to uniform golf ball standards. Fillers may also be used to modify the weight of the center or any or all core and cover layers, if present.

The initiator agent can be any known polymerization initiator which decomposes during the cure cycle. Suitable initiators include peroxide compounds such as dicumyl peroxide, 1,1-di(t-butylperoxy) 3,3,5-trimethyl cyclohexane, a—a bis (t-butylperoxy) diisopropylbenzene, 2,5-dimethyl-2,5 di(t-butylperoxy) hexane or di-t-butyl peroxide and mixtures thereof.

Crosslinkers are included to increase the hardness and resilience of the reaction product. The crosslinking agent includes a metal salt of an unsaturated fatty acid such as a zinc salt or a magnesium salt of an unsaturated fatty acid having 3 to 8 carbon atoms such as acrylic or methacrylic acid. Suitable cross linking agents include metal salt diacrylates, dimethacrylates and monomethacrylates wherein the metal is magnesium, calcium, zinc, aluminum, sodium, lithium or nickel. Preferred acrylates include zinc acrylate, zinc diacrylate, zinc methacrylate, and zinc dimethacrylate, and mixtures thereof.

The crosslinking agent must be present in an amount sufficient to crosslink a portion of the chains of polymers in the resilient polymer component. This may be achieved, for example, by altering the type and amount of crosslinking agent, a method well-known to those of ordinary skill in the art.

When the core is formed of a single solid layer comprising a high-Mooney-viscosity rubber, the crosslinking agent is present in an amount from about 15 to about 40 parts per hundred, more preferably from about 30 to about 38 parts per hundred, and most preferably about 37 parts per hundred.

In another embodiment of the present invention, the core comprises a solid center and at least one outer core layer. When the optional outer core layer is present, the center preferably comprises a high-Mooney-viscosity rubber and a crosslinking agent present in an amount from about 10 to about 30 parts per hundred of the rubber, preferably from about 19 to about 25 parts per hundred of the rubber, and most preferably from about 20 to 24 parts crosslinking agent per hundred of rubber.

The core composition should comprise at least one rubber material having a resilience index of at least about 40. Preferably the resilience index is at least about 50. Polymers that produce resilient golf balls and, therefore, are suitable for the present invention, include but are not limited to CB23, CB22, BR60, and 1207G.

Additionally, the unvulcanized rubber, such as polybutadiene, in golf balls prepared according to the invention typically has a Mooney viscosity of between about 40 and about 80, more preferably, between about 45 and about 60, and most preferably, between about 45 and about 55. Mooney viscosity is typically measured according to ASTM D-1646.

The polymers, free-radical initiators, filler, crosslinking agents, and any other materials used in forming either the golf ball center or any portion of the core, in accordance with invention, may be combined to form a mixture by any type of mixing known to one of ordinary skill in the art. Suitable types of mixing include single pass and multi-pass mixing, and the like. The crosslinking agent, and any other optional additives used to modify the characteristics of the golf ball center or additional layer(s), may similarly be combined by any type of mixing. A single-pass mixing process where ingredients are added sequentially is preferred, as this type of mixing tends to increase efficiency and reduce costs for the process. The preferred mixing cycle is single step wherein the polymer, cis-to-trans catalyst, filler, zinc diacrylate, and peroxide are added sequentially.

Suitable mixing equipment is well known to those of ordinary skill in the art, and such equipment may include a Banbury mixer, a two-roll mill, or a twin screw extruder. Conventional mixing speeds for combining polymers are typically used, although the speed must be high enough to impart substantially uniform dispersion of the constituents. On the other hand, the speed should not be too high, as high mixing speeds tend to break down the polymers being mixed and particularly may undesirably decrease the molecular weight of the resilient polymer component. The speed should thus be low enough to avoid high shear, which may result in loss of desirably high molecular weight portions of the polymer component. Also, too high a mixing speed may undesirably result in creation of enough heat to initiate the crosslinking before the preforms are shaped and assembled around a core. The mixing temperature depends upon the type of polymer components, and more importantly, on the type of free-radical initiator. Additionally, it is important to maintain a mixing temperature below the peroxide decomposition temperature. Suitable mixing speeds and temperatures are well-known to those of ordinary skill in the art, or may be readily determined without undue experimentation.

The mixture can be subjected to compression or injection molding processes, for example, to obtain solid spheres for the core or hemispherical shells for forming an intermediate layer, such as an outer core layer or an inner cover layer. The polymer mixture is subjected to a molding cycle in which heat and pressure are applied while the mixture is confined within a mold. The cavity shape depends on the portion of the golf ball being formed. The molding cycle may have a single step of molding the mixture at a single temperature for a fixed time duration. The molding cycle may also include a two-step process, in which the polymer mixture is held in the mold at an initial temperature for an initial duration of time, followed by holding at a second, typically higher temperature for a second duration of time. In a preferred embodiment of the current invention, a single-step cure cycle is employed. Single-step processes are effective and efficient, reducing the time and cost of a two-step process.

Further, the core and layers of the present invention may be reaction injection molded ("RIM"), liquid injection molded ("LIM"), or injection molded. In the most preferred embodiment, the layers of the present invention are reaction injection molded. In the RIM process, at least two or more reactive low viscosity liquid components are mixed by impingement and injected under high pressure (1200 psi or higher) into an open or closed mold. The reaction times for the RIM systems are much faster than the low pressure mixing and metered machines and, consequently, the raw materials used for the RIM process are generally much lower in viscosity to allow intimate mixing. A RIM machine can process fast reacting materials having viscosities up to about 2,000 cP and a pot life of less than about 5 seconds. Because low viscosity materials are used in the RIM process, the components are capable of being mixed by impingement in less than a second before injecting the mixed material into the closed mold at about 2,000 to about 2,500 psi. With a conventional castable urethane process, materials having viscosities greater than about 3,500 are required and also require a pot life of greater than about 35 seconds.

The polybutadiene, cis-to-trans conversion catalyst, if present, additional polymers, free-radical initiator, filler, and any other materials used in forming any portion of the golf ball core, in accordance with the invention, may be combined to form a golf ball layer by an injection molding process, which is also well-known to one of ordinary skill in the art. Although the curing time depends on the various materials selected, those of ordinary skill in the art will be readily able to adjust the curing time upward or downward based on the particular materials used and the discussion herein.

The cover provides the interface between the ball and a club. Properties that are desirable for the cover include good moldability, high abrasion resistance, high tear strength, high resilience, and good mold release. Referring to FIGS. X–Y, the cover of the present invention is a multi-layer cover, preferably comprised of at least three layers, such as an inner cover layer, an intermediate cover layer, and an outer cover layer. While the various cover layers of the present invention may be of any individual thickness, it is preferred that the combination of cover layer thicknesses be no greater than about 0.125 inches, more preferably, no greater than about 0.105 inches, and most preferably, no greater than about 0.09 inches.

Any one of the at least three cover layers preferably has a thickness of less than about 0.05 inches, and more preferably, between about 0.02 inches and about 0.04 inches. Most preferably, the thickness of any one of the layers is between about 0.03 inches and about 0.04 inches.

The inner cover and any intermediate cover layers, can include any materials known to those of ordinary skill in the art, including thermoplastic and thermosetting materials, but preferably include ionic copolymers of ethylene and an unsaturated monocarboxylic acid, such as SURLYN®, commercially available from E. I. DuPont de Nemours & Co., of Wilmington, Del., and IOTEK® or ESCOR®, commercially available from Exxon. These are copolymers or terpolymers of ethylene and methacrylic acid or acrylic acid partially neutralized with salts of zinc, sodium, lithium, magnesium, potassium, calcium, manganese, nickel or the like, in which the salts are the reaction product of an olefin having from 2 to 8 carbon atoms and an unsaturated a monocarboxylic acid having 3 to 8 carbon atoms. The carboxylic acid groups of the copolymer may be totally or partially neutralized and might include methacrylic, crotonic, maleic, fumaric or itaconic acid.

The cover materials of this invention can likewise be used in conjunction with homopolymeric and copolymer materials such as:

(1) Vinyl resins such as those formed by the polymerization of vinyl chloride, or by the copolymerization of vinyl chloride with vinyl acetate, acrylic esters or vinylidene chloride.

(2) Polyolefins such as polyethylene, polypropylene, polybutylene and copolymers such as ethylene methylacrylate, ethylene ethylacrylate, ethylene vinyl acetate, ethylene methacrylic or ethylene acrylic acid or propylene acrylic acid and copolymers and homopolymers produced using single-site catalyst.

(3) Polyurethanes including those prepared from polyols and diisocyanates or polyisocyanates and those disclosed in U.S. Pat. No. 5,334,673.

(4) Polyureas such as those disclosed in U.S. Pat. No. 5,484,870.

(5) Cationic and anionic polyurethane and polyurea ionomers, including:

(a) thermoplastic and thermoset cationic polyurethane and polyurea ionomers containing cationic moieties such as quaternized nitrogen groups associated with halide or acetate anion either on the pendant or polymer backbone of polyurethane or polyurea; or (b) thermoplastic and thermoset anionic polyurethane and polyurea ionomers containing anionic moieties such as carboxylate or sulfonate or phosphonate neutralized with counter cations either on the pendant or polymer backbone of polyurethane or polyurea.

(6) Non-elastic thermoplastics like polyesters and polyamides such as poly(hexamethylene adipamide) and others prepared from diamines and dibasic acids, as well as those from amino acids such as poly (caprolactam). Still further, non-elastic thermoplastics can include polyethylene terephthalate, polybutylene terephthalate, polyethylene terephthalate/glycol ("PETG"), polyphenylene oxide resins, and blends of non-elastic thermoplastics with SURLYN, polyethylene, ethylene copolymers, ethylene-propylene diene terpolymer, etc.

(7) Acrylic resins and blends of these resins with poly vinyl chloride, elastomers, etc.

(8) Thermoplastic rubbers such as olefinic thermoplastic rubbers including blends of polyolefins with ethylene-propylene diene terpolymer.

(9) Thermoplastic elastomers including block copolymers of styrene and butadiene, or isoprene or ethylene-butylene rubber, copoly(ether-amides) such as PEBAX sold by Elf-Atochem, copoly(ether-ester) block copolymer elastomers sold under the trademarks HYTREL from DuPont and LOMOD from General Electric Company of Pittsfield, Mass.

(10) Blends and alloys, including polycarbonate with acrylonitrile butadiene styrene, polybutylene terephthalate, polyethylene terephthalate, styrene maleic anhydride, polyethylene, elastomers, etc. Blends such as polyvinyl chloride with acrylonitrile butadiene styrene or ethylene vinyl acetate or other elastomers. Blends of thermoplastic rubbers with polyethylene, polypropylene, polyacetal, polyamides, polyesters, cellulose esters, etc.

(11) Saponified polymers and blends thereof, including: saponified polymers obtained by reacting copolymers or terpolymers having a first monomeric component having olefinic monomer from 2 to 8 carbon atoms, a second monomeric component comprising an unsaturated carboxylic acid based acrylate class ester having from 4 to 22 carbon atoms, and an optional third monomeric component comprising at least one monomer selected from the group consisting of carbon monoxide, sulfur dioxide, an anhydride, a glycidyl group and a vinyl ester with sufficient amount of an inorganic metal base. These saponified polymers can be blended with ionic and non-ionic thermoplastic and thermoplastic elastomeric materials to obtain a desirable property.

(12) Copolymer and terpolymers containing glycidyl alkyl acrylate and maleic anhydride groups, including: copolymers and terpolymers containing glycidyl alkyl acrylate and maleic anhydride groups with a first monomeric component having olefinic monomer from 2 to 8 carbon atoms, a second monomeric component comprising an unsaturated carboxylic acid based acrylate class ester having from 4 to 22 carbon atoms, and an optional third monomeric component comprising at least one monomer selected from the group consisting of carbon monoxide, sulfur dioxide, an anhydride, a glycidyl group and a vinyl ester. The above polymers can be blended with ionic and non-ionic thermoplastic and thermoplastic elastomeric materials to obtain a desirable mechanical property.

(13) HiCrystalline acid copolymers and their ionomers, including: acid copolymers or its ionomer derivatives formed from an ethylene and carboxylic acid copolymer comprising about 5 to 35 percent by weight acrylic or methacrylic acid, wherein said copolymer is polymerized at a temperature of about 130° C. to about 200° C. and a pressure of about 20,000 psi to about 50,000 psi and wherein up to about 70 percent to of the acid groups were neutralized with a metal ion.

(14) Oxa acid compounds including those containing oxa moiety in the backbone having the formula:

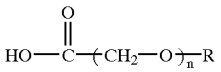

where R is an organic moiety comprising moieties having the formula:

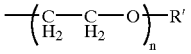

and alkyl, carbocyclic and heterocyclic groups; R' is an organic moiety comprising alkyl, carbocyclic, carboxylic acid, and heterocyclic groups; and n is an integer greater than 1. Also, R' can have the formula:

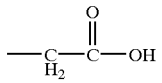

(15) Fluoropolymer including those having the following formula:

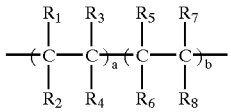

in which a is a number from 1 to 100, b is a number from 99 to 1, $R_1$–$R_7$ are independently selected from the group consisting of H, F, alkyl and aryl, and $R_8$ is F or a moiety of the formula:

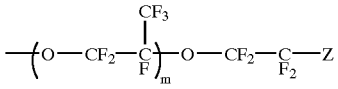

in which m is a number from 1 to 18 and Z is selected from the group consisting of $SO_2F$, $SO_3H$, $SO_3M^{v+}$, COF, $CO_2H$ and $CO_2M^{v+}$, wherein v is the valence of M and M is a cation selected from Group I, Ia, IIa, IIb, IIIa, IIIb, IVa, IVb and transition elements.

(16) Mg ionomers formed from an olefin and carboxyllic acid copolymer comprising about 5 to 35 weight percent of acrylic or methacrylic acid which are neutralized up to 60 weight percent by magnesium oxide or magnesium acetate or magnesium hydroxide.

Preferably, the inner and/or intermediate cover layer(s) are comprised of polymers such as ethylene, propylene, butene-1 or hexane-1 based homopolymers and copolymers including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethylene vinyl alcohol), poly(tetrafluoroethylene) and their copolymers including functional comonomers and blends thereof. Still further, the cover 11 is preferably comprised of a polyether or polyester thermoplastic urethane, a thermoset polyurethane, an ionomer such as acid-containing ethylene copolymer ionomers, including E/X/Y copolymers where E is ethylene, X is an acrylate or methacrylate-based softening comonomer present in 0–50 weight percent and Y is acrylic or methacrylic acid present in 5–35 weight percent. The acrylic or methacrylic acid is present in 16–35 weight percent, making the ionomer a high modulus ionomer, in 10–12 weight percent, making the ionomer a low modulus ionomer or in 13–15 weight percent, making the ionomer a standard ionomer. Generally, high acid ionomers provide a harder, more resilient ionomer. Covers made using high acid ionomers usually provide a high initial velocity and a low spin rate. On the other hand, covers made with a low modulus ionomer are generally softer and provide greater spin and control.

Preferably, the inner cover and intermediate cover layers include polymers, such as ethylene, propylene, butene-1 or hexane-1 based homopolymers or copolymers including functional monomers, such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethelyne vinyl alcohol), poly(tetrafluoroethylene) and their copolymers including functional comonomers, and blends thereof.

Suitable inner and intermediate cover layer compositions also include a polyether or polyester thermoplastic urethane, a thermoset polyurethane, a low modulus ionomer, such as acid-containing ethylene copolymer ionomers, including E/X/Y terpolymers where E is ethylene, X is an acrylate or methacrylate-based softening comonomer present in about 0 to 50 weight percent and Y is acrylic or methacrylic acid present in about 5 to 35 weight percent. More preferably, in a low spin rate embodiment designed for maximum distance, the acrylic or methacrylic acid is present in about 16 to 35 weight percent, making the ionomer a high modulus ionomer. In a higher spin embodiment, the inner cover layer includes an ionomer where an acid is present in about 10 to 15 weight percent and includes a softening comonomer.

Any cover layer, but preferably the outer cover layer, may include a polyurethane composition comprising the reaction product of at least one polyisocyanate, polyol, and at least one curing agent. Any polyisocyanate available to one of ordinary skill in the art is suitable for use according to the invention. Exemplary polyisocyanates include, but are not limited to, 4,4'-diphenylmethane diisocyanate ("MDI"); polymeric MDI; carbodiimide-modified liquid MDI; 4,4'-dicyclohexylmethane diisocyanate ("$H_{12}$MDI"); p-phenylene diisocyanate ("PPDI"); toluene diisocyanate ("TDI"); 3,3'-dimethyl-4,4'-biphenylene diisocyanate ("TODI"); isophoronediisocyanate ("IPDI"); hexamethylene diisocyanate ("HDI"); naphthalene diisocyanate ("NDI"); xylene diisocyanate ("XDI"); p-tetramethylxylene diisocyanate ("p-TMXDI"); m-tetramethylxylene diisocyanate ("m-TMXDI"); ethylene diisocyanate; propylene-1,2-diisocyanate; tetramethylene-1,4-diisocyanate; cyclohexyl diisocyanate;1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate ("TMDI"); tetracene diisocyanate; napthalene diisocyanate; anthracene diisocyanate; and mixtures thereof.

Preferably, the polyisocyanate includes MDI, PPDI, TDI, or a mixture thereof, and more preferably, the polyisocyanate includes MDI. It should be understood that, as used herein, the term "MDI" includes 4,4'-diphenylmethane diisocyanate, polymeric MDI, carbodiimide-modified liquid MDI, and mixtures thereof and, additionally, that the diisocyanate employed may be "low free monomer," understood by one of ordinary skill in the art to have lower levels of "free" monomer isocyanate groups, typically less than about 0.1% free monomer groups. Examples of "low free monomer" diisocyanates include, but are not limited to Low Free Monomer MDI, Low Free Monomer TDI, and Low Free Monomer PPDI.

The at least one polyisocyanate should have less than about 14% unreacted NCO groups. Preferably, the at least one polyisocyanate has no greater than about 7.5% NCO, and more preferably, less than about 7.0%.

Any polyol available to one of ordinary skill in the art is suitable for use according to the invention. Exemplary polyols include, but are not limited to, polyether polyols, hydroxy-terminated polybutadiene (including partially/fully hydrogenated derivatives), polyester polyols, polycaprolactone polyols, and polycarbonate polyols. In one preferred embodiment, the polyol includes polyether polyol. Examples include, but are not limited to, polytetramethylene ether glycol ("PTMEG"), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material of the invention. Suitable polyester polyols include, but are not limited to, polyethylene adipate glycol, polybutylene adipate glycol, polyethylene propylene adipate glycol, o-phthalate-1,6-hexanediol, and mixtures thereof. The hydrocarbon chain can have saturated or unsaturated bonds, or substituted or unsubstituted aromatic and cyclic groups.

In another embodiment, polycaprolactone polyols are included in the materials of the invention. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

In yet another embodiment, the polycarbonate polyols are included in the polyurethane material of the invention. Suitable polycarbonates include, but are not limited to, polyphthalate carbonate. The hydrocarbon chain can have saturated or unsaturated bonds, or substituted or unsubstituted aromatic and cyclic groups. In one embodiment, the molecular weight of the polyol is from about 200 to about 4000.

Polyamine curatives are also suitable for use in the polyurethane composition of the invention and have been found to improve cut, shear, and impact resistance of the resultant balls. Preferred polyamine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline ("MDA"); m-phenylenediamine ("MPDA"); 4,4'-methylene-bis-(2-chloroaniline) ("MOCA"); 4,4'-methylene-bis-(2,6-diethylaniline); 4,4'-diamino-3,3'-diethyl-5,5'-dimethyl diphenylmethane; 2,2', 3,3'-tetrachloro diamino diphenylmethane; 4,4'-methylene-bis-(3-chloro-2,6-diethylaniline); trimethylene glycol di-p-aminobenzoate; and mixtures thereof. Preferably, the curing agent of the present invention includes 3,5-dimethylthio-2,4-toluenediamine and isomers thereof, such as ETHACURE 300, commercially available from Albermarle Corporation of Baton Rouge, La. Suitable polyamine curatives, which include both primary and secondary amines, preferably have molecular weights ranging from about 64 to about 2000.

At least one of a diol, triol, tetraol, or hydroxy-terminated curatives may be added to the aforementioned polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy) benzene; 1,3-bis-[2-(2-hydroxyethoxy) ethoxy] benzene; 1,3-bis-{2-[2-(2-hydroxyethoxy) ethoxy] ethoxy}benzene; 1,4-butanediol; 1,5-pentanediol; 1,6-hexanediol; resorcinol-di-(β-hydroxyethyl) ether; hydroquinone-di-(β-hydroxyethyl) ether; and mixtures thereof. Preferred hydroxy-terminated curatives include ethylene glycol; diethylene glycol; 1,4-butanediol; 1,5-pentanediol; 1,6-hexanediol, trimethylol propane, and mixtures thereof. Preferably, the hydroxy-terminated curatives have molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

It should also be understood that slow-reacting amine curatives, such as VERSALINK P-250, VERSALINK P-650, and POLAMINE, and fast-reacting curatives, such as ETHACURE 100 and ETHACURE 300, may be used individually or as mixtures. Further, blending of these curatives, and/or varying the mixing temperature and speed, for example, can adjust the cure rate as desired. Light stable polyurethanes, such as those disclosed in U.S. application Ser. No. 09/812,910, filed Mar. 20, 2001, are also suitable for the layers of the present invention and are incorporated herein by express reference thereto.

Any method known to one of ordinary skill in the art may be used to combine the polyisocyanate, polyol, and curing agent of the present invention. One commonly employed method, known in the art as a one-shot method, involves concurrent mixing of the polyisocyanate, polyol, and curing agent. This method results in a mixture that is inhomogenous (more random) and affords the manufacturer less control over the molecular structure of the resultant composition. A preferred method of mixing is known as a prepolymer method. In this method, the polyisocyanate and the polyol are mixed separately prior to addition of the curing agent. This method affords a more homogeneous mixture resulting in a more consistent polymer composition.

An optional filler component may be chosen to impart additional density to blends of the previously described components. The selection of such filler(s) is dependent upon the type of golf ball desired (i.e., one-piece, two-piece multi-component, or wound). Examples of useful fillers include zinc oxide, barium sulfate, calcium oxide, calcium carbonate and silica, as well as the other well known corresponding salts and oxides thereof. Additives, such as nanoparticles, glass spheres, and various metals, such as titanium and tungsten, can be added to the polyurethane compositions of the present invention, in amounts as needed, for their well-known purposes. Additional components which can be added to the polyurethane composition include UV stabilizers and other dyes, as well as optical brighteners and fluorescent pigments and dyes. Such additional ingredients may be added in any amounts that will achieve their desired purpose.

Due to the very thin nature, it has been found by the present invention that the use of a castable, reactive material, which is applied in a fluid form, makes it possible to obtain very thin outer cover layers on golf balls. Specifically, it has been found that castable, reactive liquids, which react to form a urethane elastomer material, provide desirable very thin outer cover layers.

The castable, reactive liquid employed to form the urethane elastomer material can be applied over the core using a variety of application techniques such as spraying, dipping, spin coating, or flow coating methods which are well known in the art. An example of a suitable coating technique is that which is disclosed in U.S. Pat. No. 5,733,428, filed May 2, 1995 entitled "Method And Apparatus For Forming Polyurethane Cover On A Golf Ball," the disclosure of which is hereby incorporated by reference in its entirety in the present application.

The outer cover is preferably formed around the core and intermediate cover layers by mixing and introducing the material in the mold halves. It is important that the viscosity be measured over time, so that the subsequent steps of filling each mold half, introducing the core into one half and closing the mold can be properly timed for accomplishing centering of the core cover halves fusion and achieving overall uniformity. Suitable viscosity range of the curing urethane mix for introducing cores into the mold halves is determined to be approximately between about 2,000 cP and about 30,000 cP, with the preferred range of about 8,000 cP to about 15,000 cP.

To start the outer cover formation, mixing of the prepolymer and curative is accomplished in a motorized mixer including mixing head by feeding through lines metered amounts of curative and prepolymer. Top preheated mold halves are filled and placed in fixture units using pins moving into holes in each mold. After the reacting materials have resided in top mold halves for about 40 to about 80 seconds, a core is lowered at a controlled speed into the gelling reacting mixture. At a later time, a bottom mold half or a series of bottom mold halves have similar mixture amounts introduced into the cavity.

A ball cup holds the ball core through reduced pressure (or partial vacuum). Upon location of the coated core in the halves of the mold after gelling for about 40 to about 80 seconds, the vacuum is released allowing core to be released. The mold halves, with core and solidified cover half thereon, are removed from the centering fixture unit, inverted and mated with other mold halves which, at an appropriate time earlier, have had a selected quantity of reacting polyurethane prepolymer and curing agent introduced therein to commence gelling.

Similarly, U.S. Pat. No. 5,006,297 to Brown et al. and U.S. Pat. No. 5,334,673 to Wu both also disclose suitable molding techniques which may be utilized to apply the castable reactive liquids employed in the present invention. Further, U.S. Pat. Nos. 6,180,040 and 6,180,722 disclose methods of preparing dual core golf balls. The disclosures of these patents are hereby incorporated by reference in their entirety.

While either of the inner cover layer and the intermediate cover layer may comprise a polyurethane, as disclosed above, it is preferred that only one of the two layers comprise polyurethane. For example, if the inner cover layer comprises a thermoset polyurethane, the intermediate layer cannot comprise polyurethane, and vice versa. The outer cover layer, of course, preferably comprises polyurethane.

Depending on the desired properties, balls prepared according to the invention can exhibit substantially the same or higher resilience, or coefficient of restitution ("COR"), with a decrease in compression or modulus, compared to balls of conventional construction. Additionally, balls prepared according to the invention can also exhibit substantially higher resilience, or COR, without an increase in compression, compared to balls of conventional construction.

The resultant golf balls typically have a coefficient of restitution of greater than about 0.7, preferably greater than about 0.75, and more preferably greater than about 0.78. The golf balls also typically have an Atti compression of at least about 40, preferably from about 50 to 120, and more preferably from about 60 to 100. As used herein, the term "Atti compression" is defined as the deflection of an object or material relative to the deflection of a calibrated spring, as measured with an Atti Compression Gauge, that is commercially available from Atti Engineering Corp. of Union City, N.J. Atti compression is typically used to measure the compression of a golf ball. When the Atti Gauge is used to measure cores having a diameter of less than 1.680 inches, it should be understood that a metallic or other suitable shim is used to make the diameter of the measured object 1.680 inches.

When golf balls are prepared according to the invention, they typically will have dimple coverage greater than about 60 percent, preferably greater than about 65 percent, and more preferably greater than about 75 percent. The flexural modulus of the cover on the golf balls, as measured by ASTM method D6272-98, Procedure B, is typically greater than about 500 psi, and is preferably from about 500 psi to 150,000 psi.

The outer cover can have any material hardness sufficient to provide predetermined ball performance characteristics. In a low spin embodiment, the material of the outer cover layer should have a material hardness greater than about 55 Shore D, preferably greater than about 60 Shore D, more preferably between about 60 and about 80 Shore D, and most preferably between about 70 and about 80 Shore D. In a high spin embodiment, the material of the outer cover layer should have a material hardness less than about 65 Shore D, preferably less than about 50 Shore D, more preferably between about 10 and about 40 Shore D, and most preferably between about 30 and about 40 Shore D.

More importantly, however, is the relationship between the inner cover layer, the intermediate cover layer, and the outer cover layer. The inner and intermediate cover layers can have any material hardness sufficient to produce a predetermined set of golf ball playing characteristics. The outer cover layer has a first material hardness, the intermediate cover layer has a second material hardness, and the inner cover layer has a third material hardness. There are a number of different embodiments that will produce a low-or high-spin golf ball when that particular outer cover layer has been selected.

In a first embodiment, the third hardness is greater than the first hardness, which is greater than the second hardness i.e., the inner cover layer is the hardest layer, the intermediate layer is the softest, and the outer cover layer is the between the two. The inner cover layer hardness is preferably greater than about 60 Shore D and more preferably, greater than about 70 Shore D; the intermediate layer is preferably less than about 55 Shore D; and the outer cover layer is preferably greater than about 55 Shore D.

In a second embodiment, the second hardness is greater than the first hardness, which is greater than the third hardness, i.e., the intermediate cover layer is the hardest layer, the inner cover layer is the softest layer, and the outer cover layer is between the two. The intermediate cover layer hardness is preferably greater than about 60 Shore D, the inner cover layer hardness is preferably less than about 55 Shore D, and the outer cover layer is preferably between about 50 and about 65 Shore D.

In a third embodiment, the first and second hardness are identical and greater than the third hardness, i.e., the inner cover is softer than either the intermediate or cover layers. Preferably, the outer and intermediate cover layers have an identical hardness greater than about 60 Shore D and the inner cover layer hardness is less than about 55 Shore D.

In a fourth embodiment, the first and second hardness are identical and less than the third hardness, i.e., the inner cover layer is the hardest layer and the outer cover and intermediate cover layers are softer and identical in hardness. Preferably, the inner cover layer has a hardness greater than about 55 Shore D and the intermediate and outer cover layers have identical hardness less than about 60 Shore D.

In a fifth embodiment, the second and third hardness are identical and greater than the first hardness, i.e., the intermediate and inner cover layers are identical and harder than the outer cover layer. Preferably, the outer cover layer has a material hardness of less than about 55 Shore D and the intermediate and inner cover layers have identical hardness values greater than about 60 Shore D.

In a sixth embodiment, the second and third hardness are identical and less than the first, i.e., the intermediate and inner cover layers are identical and softer than the outer cover layer. Preferably, the intermediate and inner cover layers have an identical hardness less than about 55 Shore D and the outer cover layer has a hardness greater than about 55 Shore D.

It should be understood, especially to one of ordinary skill in the art, that there is a fundamental difference between "material hardness" and "hardness, as measured directly on a golf ball." Material hardness is defined by the procedure set forth in ASTM-D2240 and generally involves measuring the hardness of a flat "slab" or "button" formed of the material of which the hardness is to be measured. Hardness, when measured directly on a golf ball (or other spherical surface) is a completely different measurement and, therefore, results in a different hardness value. This difference results from a number of factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other. As used herein, the term "hardness" refers to material hardness, as defined above.

The core of the present invention has an Atti compression of between about 50 and about 90, more preferably, between about 60 and about 85, and most preferably, between about 70 and about 85.

The overall outer diameter ("OD") of the core is less than about 1.590 inches, more preferably between about 1.540 inches and about 1.570 inches, and most preferably between about 1.525 inches to about 1.560 inches. The OD of the inner cover layer of the golf balls of the present invention is preferably between about 1.580 inches and about 1.640 inches, more preferably between about 1.600 inches to about 1.630 inches, and most preferably between about 1.610 inches to about 1.30 inches.

The present multi-layer golf ball can have an overall diameter of any size. Although the United States Golf Association ("USGA") specifications limit the minimum size of a competition golf ball to 1.680 inches. There is no specification as to the maximum diameter. Golf balls of any size, however, can be used for recreational play. The preferred diameter of the present golf balls is from about 1.680 inches to about 1.800 inches. The more preferred diameter is from about 1.680 inches to about 1.760 inches. The most preferred diameter is about 1.680 inches to about 1.740 inches.

The term "about," as used herein in connection with one or more numbers or numerical ranges, should be understood to refer to all such numbers, including all numbers in a range.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A golf ball comprising a core and a cover disposed adjacent the core, wherein the cover comprises:

a) an inner cover layer having a first thickness and being disposed directly about the core;

b) an outer cover layer having a second thickness no greater than about 0.050 inches; and c) an intermediate cover layer having a third thickness and being disposed between the inner and outer cover layers; and wherein d) the outer cover layer comprises a composition formed of a reactive liquid material; and e) the combination of the first, second, and third thickness is no greater than about 0.125 inches; and wherein the core comprises a center and at least one outer core layer comprising a tensioned elastomeric material.

2. The golf ball of claim 1, wherein the second thickness is no greater than about 0.035 inches.

3. The golf ball of claim 2, wherein the second thickness is no greater than about 0.025 inches.

4. The golf ball of claim 1, wherein the combination of the first, second, and third thickness is no greater than about 0.105 inches.

5. The golf ball of claim 4, wherein the combination of the first, second, and third thickness is no greater than about 0.090 inches.

6. The golf ball of claim 1, wherein the reactive liquid material is a castable liquid reactive thermoset material or a reaction injection molding material.

7. The golf ball of claim 6, wherein the a castable liquid reactive thermoset material comprises polyurethane, polyurea, polyurethane ionomer, epoxy, or a mixture thereof.

8. The golf ball of claim 1, wherein the outer cover layer has a hardness of no less than about 55 Shore D.

9. The golf ball of claim 1, wherein the outer cover layer has a hardness of no greater than about 55 Shore D.

10. The golf ball of claim 1, wherein the outer cover layer comprises a thermoplastic polyurethane.

11. The golf ball of claim 1, wherein the inner cover layer and intermediate cover layer comprise a thermoplastic material.

12. The golf ball of claim 11, wherein the thermoplastic material comprises ionomers, polyolefins, metallocenes, polyesters, polyamides, thermoplastic elastomers, copolyether-amides, copolyether-esters, or mixtures thereof.

13. The golf ball of claim 1, wherein the outer cover layer has a specific gravity of between about 0.8 g/cc to about 1.4 g/cc.

14. The golf ball of claim 1, wherein the inner cover layer has a first hardness, the intermediate cover layer has a second hardness, and the outer cover layer has a third hardness, and wherein the first hardness is at least about 60 Shore D and the third hardness is less than the first hardness.

15. The golf ball of claim 14, wherein the inner cover layer has a first hardness, the intermediate cover layer has a second hardness, and the outer cover layer has a third hardness, and wherein the second hardness is less than about 55 Shore D and the third hardness is greater than about 55 Shore D.

16. The golf ball of claim 15, wherein the inner cover layer has a first hardness, the intermediate cover layer has a second hardness, and the outer cover layer has a third hardness, and wherein the second hardness is less than about 55 Shore D and the third hardness is less than about 55 Shore D.

17. The golf bail of claim 1, wherein the inner cover layer has a first hardness, the intermediate cover layer has a second hardness, and the outer cover layer has a third hardness, and wherein the second hardness is greater than about 55 Shore D and the third hardness is greater than about 55 Shore D.

18. The golf ball of claim 1, wherein the inner cover layer has a first hardness, the intermediate cover layer has a second hardness, and the outer cover layer has a third hardness, and wherein the second hardness is greater than about 55 Shore D and the third hardness is less than about 55 Shore D.

19. The golf ball of claim 1, wherein the inner cover layer has a first hardness, the intermediate cover layer has a second hardness, and the outer cover layer has a third hardness, and wherein the second hardness is less about 55 Shore D and less than the first or third hardness.

20. The golf ball of claim 1, wherein the inner cover layer has a first hardness, the intermediate cover layer has a second hardness, and the outer cover layer has a third hardness, and wherein the first hardness is less than the second or third hardness.

21. The golf ball of claim 1, wherein the core has an outer diameter of about 1.40 inches to about 1.60 inches.

22. The golf ball of claim 1, wherein the inner cover layer has a first hardness, the intermediate cover layer has a second hardness, and the outer cover layer has a third hardness, and wherein the first hardness is less than about 60 Shore D and less than the second hardness.

23. The golf ball of claim 1, wherein the inner cover layer has a first hardness, the intermediate cover layer has a second hardness, and the outer cover layer has a third hardness, and wherein the second hardness is less than the third hardness.

24. The golf ball of claim 1, wherein the inner cover layer has a first hardness, the intermediate cover layer has a second hardness, and the outer cover layer has a third hardness, and wherein the second hardness is greater than the third hardness.

25. The golf ball of claim 1, wherein the inner cover layer has a first hardness, the intermediate cover layer has a second hardness, and the outer cover layer has a third hardness, and wherein the first hardness is less than about 45 Shore D.

26. The golf ball of claim 1, wherein the inner cover layer has a first hardness, the intermediate cover layer has a second hardness, and the outer cover layer has a third hardness, and wherein the first hardness is greater than about 70 Shore D.

27. The golf ball of claim 1, wherein the inner cover layer has a first hardness, the intermediate cover layer has a second hardness, and the outer cover layer has a third hardness, and wherein the third hardness is less than about 45 Shore D, and the second hardness is less than the first hardness and greater than the third hardness.

28. A golf ball comprising a core and a cover disposed adjacent the core, wherein the cover comprises:

a) an inner cover layer having a first thickness and being disposed directly about the core;

b) an outer cover layer having a second thickness no greater than about 0.050 inches; and c) an intermediate cover layer having a third thickness and being disposed between the inner and outer cover layers; and wherein d) the outer cover layer comprises a composition formed of a reactive liquid material; and e) the combination of the first, second, and third thickness is no greater than about 0.125 inches; and wherein the core comprises a liquid-filled, hollow, foam, gel-filled, or gas-filled center; and at least one outer core layer.

29. A golf ball comprising a core and a cover disposed adjacent the core, wherein the cover comprises:

a) an inner cover layer having a first thickness and being disposed directly about the core;

b) an outer cover layer having a second thickness no greater than about 0.050 inches; and c) an intermediate cover layer having a third thickness and being disposed between the inner and outer cover layers; and wherein d) the outer cover layer comprises a composition formed of a reactive liquid material; and e) the combination of the first, second, and third thickness is no greater than about 0.125 inches; and wherein at least one of the intermediate or inner cover layers comprises a reaction injection molded material.

30. A golf ball comprising a core and a cover disposed adjacent the core, wherein the cover comprises:

a) an inner cover layer having a first thickness and being disposed directly about the core;

b) an outer cover layer having a second thickness no greater than about 0.050 inches; and c) an intermediate cover layer having a third thickness and being disposed between the inner and outer cover layers; and wherein d) the outer cover layer comprises a composition formed of a reactive liquid material; and e) the combination of the first, second, and third thickness is no greater than about 0.125 inches; and wherein the core comprises an inner core layer having a first specific gravity and an outer core layer having a second specific gravity, wherein the first specific gravity is less than the second specific gravity.

31. A golf ball comprising a core and a cover disposed adjacent the core, wherein the cover comprises:

a) an inner cover layer having a first thickness and being disposed directly about the core;

b) an outer cover layer having a second thickness no greater than about 0.050 inches; and c) an intermediate cover layer having a third thickness and being disposed between the inner and outer cover layers; and wherein d) the outer cover layer comprises a composition formed of a reactive liquid material; and e) the combination of the first, second, and third thickness is no greater than about 0.125 inches; and wherein the core comprises an inner core layer having a first specific gravity and an outer core layer having a second specific gravity, wherein the first specific gravity is greater than the second specific gravity.

32. A golf ball comprising a core and a cover disposed adjacent the core, wherein the cover comprises:

a) an inner cover layer having a first thickness and being disposed directly about the core;

b) an outer cover layer having a second thickness no greater than about 0.050 inches; and c) an intermediate cover layer having a third thickness and being disposed between the inner and outer cover layers; and wherein d) the outer cover layer comprises a composition formed of a reactive liquid material; and e) the combination of the first, second, and third thickness is no greater tan about 0.125 inches; and wherein the core comprises polybutadiene rubber, high-Mooney viscosity polybutadiene rubber, polybutadiene rubber having a trans- isomer content of greater than about 30%, and mixtures thereof.

* * * * *